United States Patent [19]

Beamon et al.

[11] 4,432,554

[45] Feb. 21, 1984

[54] WORD GAME APPARATUS

[76] Inventors: Earl T. Beamon, 289 Conestoga St., Windsor, Conn. 06095; Joanne M. Bouchard, 15 Grafton St., Hartford, Conn. 06106

[21] Appl. No.: 348,780

[22] Filed: Feb. 16, 1982

[51] Int. Cl.[3] ..... A63F 3/00

[52] U.S. Cl. ..... 273/272

[58] Field of Search ..... 273/272, 291, 282, 241, 296, 273/299

[56] References Cited

U.S. PATENT DOCUMENTS

| | | | |
|---|---|---|---|
| 1,732,980 | 10/1929 | Mooney | 273/299 X |
| 1,988,301 | 1/1935 | Coffin | 273/282 X |
| 3,413,004 | 11/1968 | Smith | 273/272 X |
| 3,427,028 | 2/1969 | Abrahamsen | 273/272 |
| 3,506,267 | 4/1970 | Taillie | 273/240 X |
| 3,606,336 | 9/1971 | Krause | 273/272 |

FOREIGN PATENT DOCUMENTS

| | | | |
|---|---|---|---|
| 259924 | 11/1927 | United Kingdom | 273/156 |

*Primary Examiner*—Richard C. Pinkham
*Assistant Examiner*—Scott L. Brown
*Attorney, Agent, or Firm*—McCormick, Paulding & Huber

[57] ABSTRACT

A game apparatus for playing a competitive word game includes a two-sided game board, a plurality of pegs, a stand, and a spinner. The stand includes means for holding the game board vertically and means for holding a supply of pegs. The game board has a plurality of openings completely through the board through which the pegs may be inserted endwise. Some of the pegs bear a letter on each of their opposite end surfaces with the letter on each end surface being different on the opposite end surface. In addition to the differing letter, each end surface has a characteristic which visibly distinguishes the end surface from its opposite end surface. The end surfaces of the pegs placed in the game board are visible to players viewing either of the sides of the game board. The spinner provides means by which a player determines, by chance, a course of action to take during his turn.

8 Claims, 7 Drawing Figures

WORD GAME APPARATUS

BACKGROUND OF THE INVENTION

This invention relates generally to game apparatus and more particularly to game apparatus for forming words with pieces individually marked with letters of the alphabet.

Various game apparatus exist which include a perforated two-sided game board vertically positionable between two playing stations and a plurality of playing pieces insertable through the openings in the board. Each playing piece has opposite sides bearing some distinctive mark, such as a letter of the alphabet, and when a playing piece is placed through a game board opening, its marked sides are visible to players viewing either game board side. According to rules of games playable with such apparatus, players at each station take turns placing a number of playing pieces into the board openings with the object of forming a chain or word along a series of openings with the marks on the sides of the pieces facing his playing station. Game apparatus, as described above, and a corresponding set of game rules are set out in detail in U.S. Pat. Nos. 3,427,028 and 3,506,267.

It is a general object of this invention to provide a new and improved word game apparatus including as part of the apparatus a vertically positionable two-sided game board and pieces insertable through the board. Word games which may be played with the apparatus of this invention are intellectually stimulating and are likely to increase a player's vocabulary.

It is a further object of this invention to provide a game apparatus which includes a plurality of playing pieces each having visibly distinguishable opposite end surfaces.

It is still a further object of this invention to provide a game apparatus which includes a stand for supporting the game board in a vertical position and for holding the playing pieces until the pieces are needed for placement in the board during a game.

SUMMARY OF THE INVENTION

This invention resides in a word game apparatus. The apparatus includes a plurality of playing pieces in the form of elongated cylindrical pegs, a game board having substantial planar and parallel opposite faces, and a stand for supporting the game board with its opposite faces positioned vertically and for holding a supply of pegs. A number of the pegs bear a letter of the alphabet on each of their opposite end surfaces with the letter on one end surface being different than the letter on the opposite surface. Furthermore, each of the opposite end surfaces of the letter-bearing pegs has a characteristic which visibly distinguishes each end surface from its opposite end surface. The remaining number of the pegs having blank end surfaces. The game board defines a plurality of circular openings extending completely through the board and arranged in a matrix pattern on each of its faces. Each of the game board openings is of such size to loosely receive a peg inserted endwise therethrough. The game apparatus further includes means for indicating by chance the course of action a player must take regarding the addition of pegs to and the removal of pegs from the game board during a game.

DETAILED DESCRIPTION OF THE PREFERRED EMBODIMENT

Figure 1:
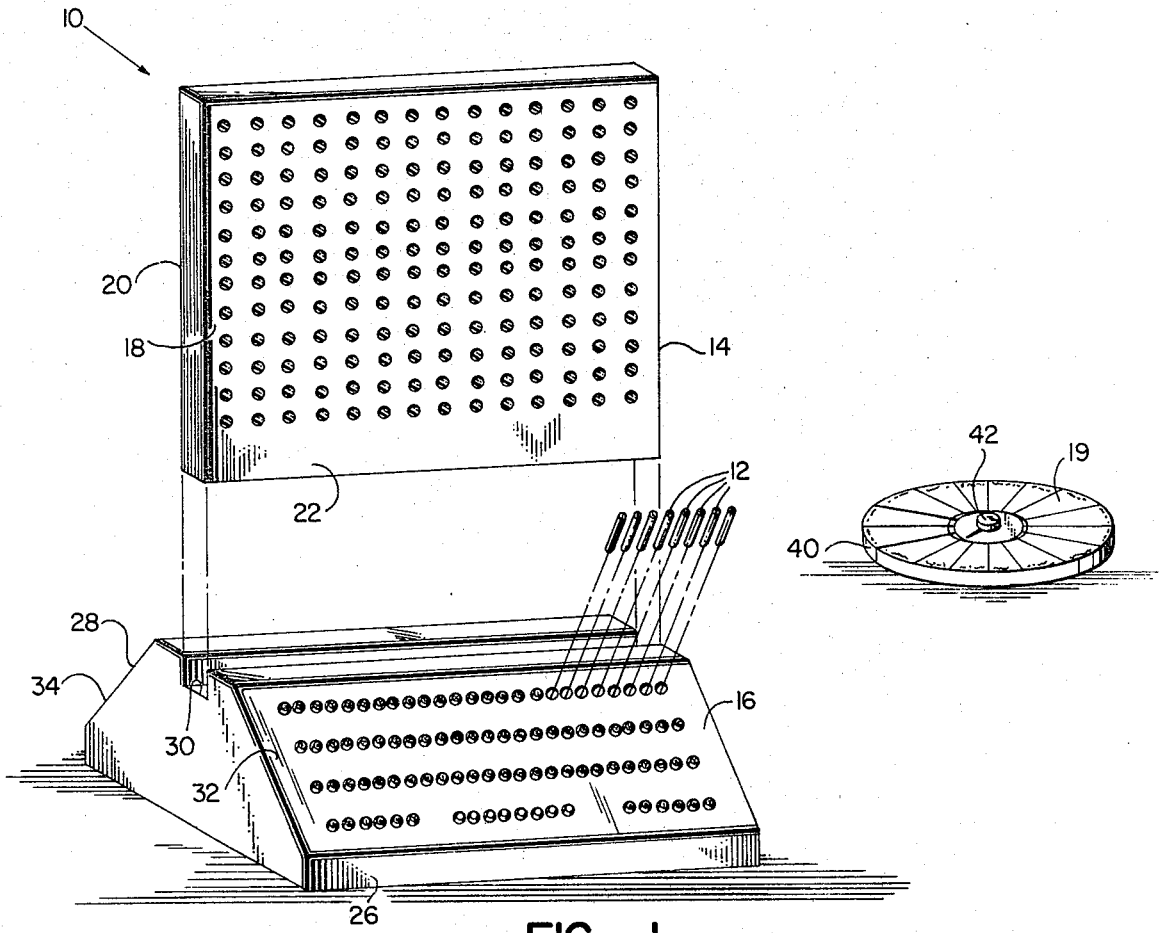
FIG. 1 is an exploded perspective view of the game apparatus of the present invention.

The game apparatus of this invention, indicated generally at 10 in FIG. 1, is comprised of a plurality of playing pieces in the form of pegs 12, 12, a game board 14, a stand 16, and indicator means in the form of a spinner 19. As will become hereinafter apparent, the game apparatus is best suited for games playable between two players or two teams of players.

Figure 2:
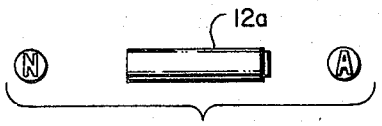
FIG. 2 is a side view and end surface views of a letter-bearing peg of the FIG. 1 game apparatus.
Figure 3:
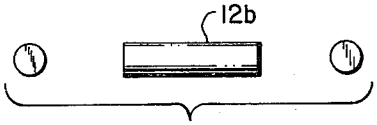
FIG. 3 is a side view and end surface views of a blank peg of the FIG. 1 game apparatus.

Each peg is elongated and cylindrically shaped with planar and parallel opposite end surfaces, and each, preferably, is made of wood or plastic. The total number of pegs are comprised of lettered pegs, as 12*a* in FIG. 2, bearing a letter on each of their end surfaces and unlettered pegs, as 12*b* in FIG. 3, having blank end surfaces. The letters on each of the lettered pegs are both oriented in right-reading position when the end surfaces are simultaneously viewed by players facing them.

In accordance with this invention, the letter on one end surface of each lettered peg is different than the letter on its opposite end surface. Furthermore, the opposite end surface of each lettered peg possesses, in addition to the different letter, a characteristic which visibly distinguishes one end surface from its opposite end surface. The aforedescribed peg features are illustrated by the peg 12*a* of FIG. 2. One end surface of the peg bears the letter "N" and the other end bears the letter "A". The characteristic distinguishing one end from the other is that the letter "N" lies in the plane of its respective end surface and the letter "A" is embossed on its respective surface. Preferably, the distinguishing features of the end surfaces of one lettered peg are common to all so that, for example, all of the lettered pegs have one letter in the plane of an end surface and an embossed letter. Advantages of the distinguishability of the end surfaces will be apparent hereinafter.

In a preferred embodiment of the invention, there are 196 pegs of which 180 are lettered. Before a game, each player, or team, is allotted one-half the total number of lettered and unlettered pegs. The letters borne of each player's allotted pegs are identical to those allotted to another player so that the letters, as well as pegs, are fairly divided. The chart below indicates a preferred scheme of letters borne on opposite ends of the lettered pegs allotted to one player:

| One Side | Other Side | One Side | Other Side | One Side | Other Side | One Side | Other Side | One Side | Other Side |
|---|---|---|---|---|---|---|---|---|---|
| A | N | S | H | K | E | C | D | U | V |
| B | O | T | G | L | F | D | E | V | W |
| C | P | U | F | M | T | E | F | W | X |
| D | Q | V | E | N | U | F | G | X | Y |
| E | R | W | D | O | V | G | H | Y | Z |
| F | S | X | C | P | W | H | I | Z | A |
| G | T | Y | B | Q | X | I | J | A | B |
| H | U | Z | A | R | Y | J | K | E | C |
| I | V | A | M | S | G | K | L | I | D |
| J | W | B | N | T | H | L | M | O | I |
| K | X | C | O | U | I | M | N | U | H |
| L | Y | D | P | V | J | N | O | Y | K |
| M | Z | E | Q | W | K | O | P | A | L |
| N | M | F | R | X | L | P | Q | E | M |
| O | L | G | A | Y | Z | Q | R | I | N |
| P | K | H | B | Z | S | R | S | O | Z |
| Q | J | I | C | A | B | S | T | U | W |
| R | I | J | D | B | C | T | U | Y | T |

A scan of the letters in the columns entitled "one side" reveals four complete sets of alphabet letters and two additional sets of vowels. In a game played with this apparatus described hereinafter, a player is not entitled to "play" any more letters than are shown in the "one side" column, or four of each alphabet consonant and six of each alphabet vowel. Because the end surfaces on "one side" are visibly distinguishable from the "other side", it is an easy task for a player to guard against his "playing" of more letters than the rules allow.

Figure 4:
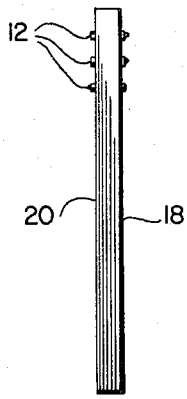
FIG. 4 is a side elevational view of the game board of the FIG. 1 game apparatus with playing pieces being positioned in some of the game board openings.

Referring to FIGS. 1 and 4, the game board 14 of the apparatus is in the form of a broad rectangular platen having substantially planar and parallel opposite faces 18 and 20 and a base portion 22 along one edge. The game board may be made of wood, plastic or any suitable material which provides the game board with sufficient strength so that it is self-supportive when supported upright from its base portion 22. The game board defines a plurality of circular openings 24, 24 extending completely through the board and arranged in a matrix pattern on each of its faces 18 and 20. In the game board embodiment shown in FIGS. 1 and 4, the openings on each face are arranged in twelve horizontal rows and fourteen vertical columns. Each of the openings are of such a size to loosely receive a peg inserted endwise therethrough. As shown in FIG. 4, the thickness of the board as measured between its opposite faces is great enough to support pegs horizontally and is preferably no greater than the length of a peg so that a player may easily insert or remove a peg with his fingers and the end surfaces of pegs in the game board are clearly visible to players viewing either of the game board faces.

Figure 5:
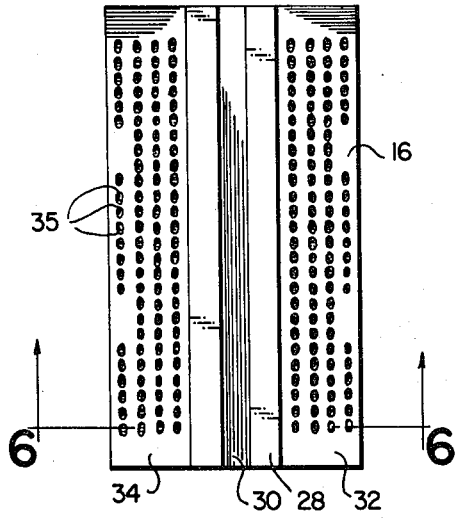
FIG. 5 is a plan view of the stand of the FIG. 1 game apparatus.
Figure 6:
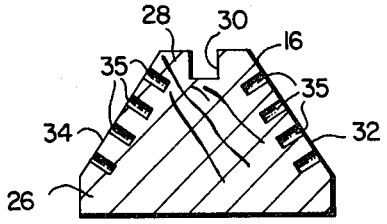
FIG. 6 is an end cross-sectional view as taken along the line 6—6 of FIG. 5.

The stand 16 of the game apparatus includes means for holding the game board upright from its base portion 22 with its faces 18, 20 positioned vertically. Referring to FIGS. 1, 5 and 6, the stand is blockish in shape with a broad flat lower portion 26 and a recessed upper portion 28. The upper portion 28 defines a recess 30 of such size and shape to snugly receive the base portion 22 of the game board when the base portion is inserted therein. The stand is preferably made of a wood or hard plastic so that when its lower portion 26 rests against a horizontal surface, the stand is provided with enough structural stiffness to support the game board upright within the recessed upper portion 28.

The stand 16 also includes means for holding a supply of pegs for use during a game. As shown in FIGS. 5 and 6, the pegholding means is provided by two rectangular-shaped surfaces 32, 34 arranged on opposite sides of the recessed upper portion 28 and defining a plurality of circular recesses 35, 35. Each circular recess 35 is of such size to loosely receive a peg inserted endwise therein and has a depth no greater than the length of a peg so that once a peg is positioned in a recess, it may be easily removed by grasping the portion of the peg protruding above the plane of the surface 32 or 34. As best shown in FIGS. 1 and 6, the peg-holding surfaces 32, 34 are inclined to generally face a respective playing station and thereby permit a player viewing a game board face 18 or 20 conveniently view the end surfaces of pegs positioned in the surface recesses 35, 35. In the stand embodiment shown, each stand surface 32, 34 defines a total of 98 recesses so that each surface may accommodate the aforementioned total number of pegs in each player's preferred allotment.

It is a player's object in a word game played with the apparatus of this invention to accumulate points by spelling words in a horizontal or vertical series of game board openings with the lettered end surfaces of pegs placed in the game board and facing a respective player's station. The most challenging of the games playable with this apparatus are those in which a player, in turn, may add pegs to or take pegs from the game board in strategic efforts to spell words on his side of the game board while preventing an opponent from spelling words on the opposite side of the game board. To determine a course of action a player must take regarding the adding of pegs to or the removal of pegs from a game board, the apparatus includes some sort of indicator means for making such a determination by chance. The indicator means is shown in the FIG. 1, embodiment to be in the form of a spinner 19. The indicator means could as easily be a die or coin with particular die or coin sides corresponding to a particular course of playing action. A spinner, however, is particularly well suited for this game apparatus since the possible courses of action may be printed on a surface.

Figure 7:
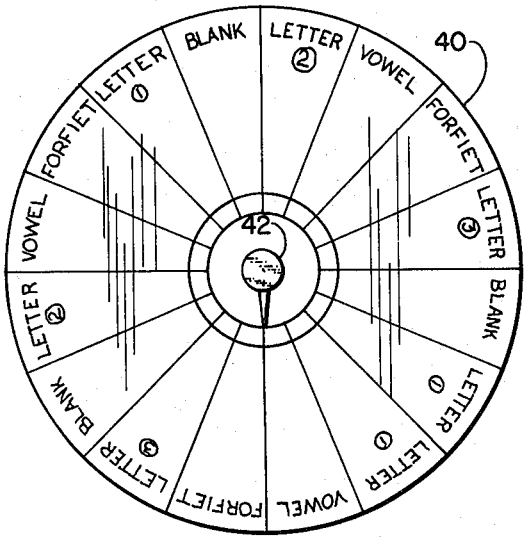
FIG. 7 is a plan view of the spinner of the FIG. 1 game apparatus.

The spinner 19 is constructed of a flat piece 40 of cardboard or plastic and a pointer 42 supported at a point on the flat piece for spinning relative to the flat piece by a player. As shown in FIG. 7, words signifying a course of action are arranged circumferentially about the pointer's support point. Words marked on the spinner shown are LETTER, VOWEL, FORFEIT and BLANK. In addition, a number 1, 2 or 3 is marked adjacent the word LETTER.

Before the start of a game, the stand 16, with game board 14, is positioned between two playing stations so that each game board face forms a field of play for a player, or a team of players, at a respective station. All the pegs are initially held in the recessed surfaces of the stand 16 so that the game board is free of pegs. The spinner 19 rests on a horizontal surface near the stand and game board so as to be accessible to opposing players. If the spinner comes to rest on the word LETTER, the player places in the pegboard any of his pegs up to the number indicated adjacent the word LETTER. If the pointer comes to rest on the word VOWEL, the player must put in the game board a peg having an end surface marked with a VOWEL. If the spinner rests on the work BLANK, the player must put a blank peg in the game board. If the pointer rests on the word FORFEIT, the player must remove from the game board a lettered peg he has placed in the board. If a player lands on FORFEIT when he has no pegs in the board, as may be the case at the start of a game, the player must forfeit his next turn.

A player's object during the game is to spell as many words as he can across or down with the letters of pegs placed in the pegboard which face his playing station. While spelling a word, the end surface letters of pegs placed in the board by an opponent may be used. However, a player may only put letters into the game board in such a manner that the end surfaces of pegs bearing his allotment of letters (four of each alphabent consonant and six of each alphabet vowel) face his playing station. This rule was introduced above when mention was made that a player may not "play" more letters than those he was initially allotted. A player accumulates points for each word with more than four letters that he is able to spell. The points which may be received per word is dependent upon the letters of the word spelled. A four- or five-letter word is worth one point, a six- or seven-letter word is worth four points, a eight- or nine-letter word is worth eight points, a nine-, ten- or eleven-letter word is worth ten points, and a word with more than eleven letters is worth ten points plus the number of letters over eleven letters. Play ends when one player or team of players accumulates a prescribed number of points.

To further enhance the challenge of the game, it is suggested that a number of special rules exist. Examples of special rules found to be worthwhile include (1) that a vowel-marked peg must be placed in a game board opening adjacent a peg already placed in the game board, (2) if the pointer of the spinner rests on the word FORFEIT three turns in a row for a player, that player must forfeit the points of the last word he has spelled, or (3) a blank peg, used primarily to block the word spelling by the competing player, can be removed by a player when, in his turn, the spinner pointer rests on the word LETTER with the numbers 2 or 3 adjacent the word LETTER, and if, after removing a blank peg, the player, in his same turn, may substitute a lettered peg in the blank peg's place.

Although a specific embodiment of the invention has been described, it will be understood that modifications may be had to the game apparatus without departing from the spirit of the invention. Rules may be formulated for a word game other than the game described herein, and game rules may be formulated to enable a player to play alone. According, the aforementioned descriptions are intended as illustration and not as limitation.

We claim:

1. A word game apparatus for playing a two player game, said apparatus comprising:

a plurality of playing pieces, each in the form of an elongated cylindrical peg with opposite end surfaces, a number of said pegs being letter pegs bearing a letter of the alphabet on each of their opposite end surfaces, the letter on one end surface of each letter peg being different than the letter on its opposite end surface and each of said opposite end surfaces having a characteristic which visibly distinguishes it from its opposite end surface, the letters on the end surfaces of one characteristic therefore forming one set of letters which may be assigned to one player and the letters on the end surface of the other characteristic forming a second set of letters which may be assigned to the other player, said letter pegs being of sufficient variety as to permit the formation of a numerous variety of words from the letters of each set, the remaining number of said pegs being blank pegs having blank opposite end surfaces, a self-supportive game board in the form of a broad, rectangular platen having substantially planar and parallel opposite board faces and also having a base portion along one edge of said platen, said platen including circular openings extending completely through said game board and arranged in a matrix pattern on each of said faces, each of said openings being of such size as to loosely receive one of said pegs inserted endwise therethrough so that after such insertion one of its end surfaces will appear adjacent one of said board faces and the other of its end surfaces will appear adjacent the other of said board faces, a stand including means for supporting said game board upright from its base portion with its opposite faces positioned vertically and means for holding a supply of said pegs, and means for indicating by chance a course of action a player must take regarding the addition of pegs to and the removal of pegs from said game board during a game.

2. A word game apparatus as defined in claim 1 wherein each of said letter-bearing pegs has substantially planar and parallel opposite end surfaces with one of its letters lying in the plane of one end surface, and the other of its letters being embossed on the opposite end surface.

3. A word game apparatus as defined in claim 1 wherein said stand includes a broad lower portion for resting against a horizontal surface during a game, said means for supporting said game board upright is provided by a recessed upper portion of said stand, the recesses of said upper portion being of such size and shape to snugly receive said base portion of said game board when said base portion is inserted therein, and said means for holding a supply of said pegs is provided by two stand surfaces arranged so that when said game board is supported by said stand each of said surfaces is below and adjacent a respective face of said game board, each of said two surfaces defining a plurality of circular recesses having a depth no greater than the length of one of said pegs and each being of such size so as to loosely receive a peg inserted endwise therein.

4. A word game apparatus as defined in claim 1 or 3 wherein said stand is blockish in shape and symmetrical about a plane in which said game board is supported by said stand.

5. A word game apparatus as defined in claim 1 wherein said means for indicating by chance comprises means for selecting a single course of action from a group of possible courses of action, one such course of action being adding a letter and another such course of action being adding a vowel.

6. A word game apparatus as defined in claim 5 wherein said group of possible courses of action further includes the course of adding a blank.

7. A word game apparatus as defined in claim 6 wherein said group of possible courses of action further includes the course of removing a letter.

8. A word game apparatus as defined in claim 7 wherein said means for indicating by chance includes a flat piece of material on which words signifying instructions of said courses of action are arranged circumferentially about a point and a pointer supported at said point for spinning relative to said flat piece by a player.

* * * * *